US007434613B2

(12) United States Patent
Restarick et al.

(10) Patent No.: US 7,434,613 B2
(45) **Date of Patent: *Oct. 14, 2008**

(54) SURFACE CONTROLLED SUBSURFACE LATERAL BRANCH SAFETY VALVE

(75) Inventors: Henry L. Restarick, Carrollton, TX (US); Jody R. McGlothen, Waxahachie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/753,000

(22) Filed: May 24, 2007

(65) Prior Publication Data

US 2007/0221380 A1 Sep. 27, 2007

Related U.S. Application Data

(60) Continuation of application No. 11/170,256, filed on Jun. 29, 2005, now Pat. No. 7,337,846, which is a division of application No. 10/253,671, filed on Sep. 24, 2002, now Pat. No. 6,951,252.

(51) Int. Cl.
*E21B 43/14* (2006.01)

(52) U.S. Cl. ..... 166/50; 166/242.1

(58) Field of Classification Search ..... 166/313, 166/50, 117.6, 115, 242.1
See application file for complete search history.

(56) References Cited

U.S. PATENT DOCUMENTS

| | | | |
|---|---|---|---|
| 2,375,865 | A | 5/1945 | Nebolsine |
| 3,261,401 | A | 7/1966 | Karr |
| 4,646,836 | A | 3/1987 | Goodhart |
| 5,123,488 | A | 6/1992 | Jennings, Jr. |
| 5,127,457 | A | 7/1992 | Stewart et al. |
| 5,311,936 | A | 5/1994 | McNair et al. |
| 5,318,122 | A | 6/1994 | Murray et al. |
| 5,330,007 | A | 7/1994 | Collins et al. |
| 5,339,904 | A | 8/1994 | Jennings, Jr. et al. |
| 5,361,843 | A | 11/1994 | Shy et al. |
| 5,462,120 | A | 10/1995 | Gondouin |

(Continued)

FOREIGN PATENT DOCUMENTS

| | | |
|---|---|---|
| CA | 2301966 | 9/2001 |
| GB | 2345933 | 7/2000 |
| WO | WO0111185 | 2/2001 |
| WO | WO0171151 | 9/2001 |

OTHER PUBLICATIONS

Office action for U.S. Appl. No. 10/253,136 dated Jan. 5, 2004.
Office action for U.S. Appl. No. 10/253,324 dated Mar. 30, 2004.
International Search Report for application No. PCT/US03/26791.
International Search Report for application No. PCT/US03/26360.
U.K. Search Report for application No. GB 0322266.8.
Office action for U.K. application No. GB 0409495.9 dated Jun. 7, 2005.
Office action for U.S. Appl. No. 10/253,671 dated May 19, 2004.
Office Action for U.S. Appl. No. 10/253,671 dated Nov. 17, 2004.

*Primary Examiner*—Hoang Dang
(74) *Attorney, Agent, or Firm*—Marlin R. Smith

(57) ABSTRACT

A surface controlled subsurface lateral branch safety valve provides flow control for each branch wellbore in a multilateral well. In a described embodiment, a completion system for a well having an intersection between parent and branch wellbores includes an apparatus having multiple passages formed therethrough. One passage provides fluid communication between opposite ends of the apparatus in the parent wellbore, and another passage provides guidance for drilling the branch wellbore. The apparatus further includes a flow control device, such as a surface controlled subsurface safety valve, which selectively controls fluid communication with the branch wellbore.

4 Claims, 6 Drawing Sheets

U.S. PATENT DOCUMENTS

| | | | |
|---|---|---|---|
| 5,477,925 | A | 12/1995 | Trahan |
| 5,484,383 | A | 1/1996 | Fitch, Jr. et al. |
| 5,680,901 | A | 10/1997 | Gardes |
| 5,839,508 | A | 11/1998 | Tubel et al. |
| 5,868,210 | A | 2/1999 | Johnson et al. |
| 5,875,847 | A | 3/1999 | Forsyth |
| 5,878,815 | A | 3/1999 | Collins |
| 5,879,108 | A | 3/1999 | Haddad |
| 5,941,308 | A | 8/1999 | Malone et al. |
| 6,012,516 | A | 1/2000 | Brunet |
| 6,079,494 | A | 6/2000 | Longbottom et al. |
| 6,082,455 | A | 7/2000 | Pringle et al. |
| 6,089,320 | A | 7/2000 | LaGrange |
| 6,119,771 | A | 9/2000 | Gano et al. |
| 6,247,532 | B1 | 6/2001 | Ohmer |
| 6,253,846 | B1 | 7/2001 | Nazzai et al. |
| 6,279,651 | B1 | 8/2001 | Schwendemann et al. |
| 6,279,658 | B1 | 8/2001 | Donovan et al. |
| 6,354,375 | B1 | 3/2002 | Dewey |
| 6,422,312 | B1 | 7/2002 | Delatorre et al. |
| 6,431,283 | B1 | 8/2002 | Dale |
| 6,464,011 | B2 | 10/2002 | Tubel |
| 6,481,503 | B2 | 11/2002 | Hamilton |
| 6,491,101 | B2 | 12/2002 | Ohmer |
| 6,564,867 | B2 | 5/2003 | Ohmer |
| 6,568,469 | B2 | 5/2003 | Ohmer |
| 6,615,920 | B1 | 9/2003 | Collins et al. |
| 6,789,628 | B2 | 9/2004 | Hess |
| 6,863,129 | B2 | 3/2005 | Ohmer et al. |
| 2002/0023754 | A1 | 2/2002 | Buytaert |
| 2002/0053437 | A1 | 5/2002 | Ohmer |
| 2002/0088621 | A1 | 7/2002 | Hamilton |
| 2002/0112857 | A1 | 8/2002 | Ohmer |
| 2003/0024700 | A1 | 2/2003 | Cavender |

SURFACE CONTROLLED SUBSURFACE LATERAL BRANCH SAFETY VALVE

CROSS-REFERENCE TO RELATED APPLICATIONS

The present application is a continuation of application Ser. No. 11/170,256 filed Jun. 29, 2005 now U.S. Pat. No. 7,337,846 which is a division of application Ser. No. 10/253,671 filed Sep. 24, 2002, now U.S. Pat. No. 6,951,252. The entire disclosures of these earlier applications are incorporated herein by this reference.

BACKGROUND

The present invention relates generally to operations performed and equipment utilized in conjunction with a subterranean well and, in an embodiment described herein, more particularly provides a surface controlled subsurface lateral branch safety valve and associated systems and methods.

In some jurisdictions, commingling production from different reservoirs is allowed. This is flow from each of multiple branch wellbores into a common main or parent wellbore extending to the surface. It is appreciated by those skilled in the art that this is a difficult task, and yet several systems have been proposed for complying with this requirement. Unfortunately, each of these proposed systems suffers from at least one major drawback.

One system uses a completion string installed in the main wellbore. The completion string includes a flow control device, such as a valve or choke, for each branch wellbore. Packers are interconnected in the completion string between the flow control devices to isolate the branch wellbores from each other. The flow control devices are positioned opposite their respective branch wellbores, and the flow control devices are used to regulate flow from the individual branch wellbores into the completion string.

This system restricts the area available for production to the inner diameter of the completion string. In addition, this system prevents access to the branch wellbores. To provide access to a branch wellbore, the completion string must be pulled out of the main wellbore, which is very costly and time-consuming.

In another system, a flow control device is positioned in each one of multiple branch wellbores. The flow control devices are controlled by use of cables, control lines, power lines, etc., extending into each branch wellbore from the main wellbore. Alternatively, the flow control devices may be battery-powered and/or may be remotely controlled via telemetry.

This system has the disadvantage that the flow control devices must be positioned in the branch wellbores, where they are difficult to access for maintenance, etc. In addition, the version having cables, lines, etc. extending in the main and branch wellbores has the disadvantages of restricting access through the wellbores, the possibility of damage to the lines and cables, the difficulty of installing the flow control devices, lines and cables, etc. If the flow control devices are battery-powered, the need to periodically replace or recharge the batteries increases the disadvantage of difficult access to the flow control devices in the branch wellbores.

Therefore, it is known to those skilled in the art that an improved system and method of controlling flow between branch and main wellbores is needed.

SUMMARY

In carrying out the principles of the present invention, in accordance with an embodiment thereof, a well completion system is provided which solves the above problems in the art. In this embodiment, a surface controlled subsurface safety valve is used to control flow from each lateral branch wellbore in a multilateral well.

In one aspect of the invention, a completion system for a well having an intersection between first and second wellbores is provided. The system includes an apparatus having first and second passages formed therethrough. The first passage provides fluid communication between opposite ends of the apparatus in the first wellbore. The second passage provides guidance for drilling the second wellbore extending laterally from the first wellbore. The apparatus further includes a flow control device selectively controlling fluid communication with the second passage.

In another aspect of the invention, a method of completing a well having an intersection between first and second wellbores is provided. The method includes the steps of: interconnecting a mandrel as part of a casing string, a first longitudinal passage of the casing string extending through the mandrel; positioning the mandrel in the well at the desired intersection of the first and second wellbores; drilling the second wellbore by deflecting a cutting tool from the first passage and through a second passage formed in the mandrel; and flowing fluid between the first and second wellbores through the mandrel, without flowing fluid directly between the first and second passages.

In yet another aspect of the invention, an apparatus for use in completing a well having intersecting first and second wellbores is provided. The apparatus includes an elongated mandrel configured for interconnection in a casing string in the well. The mandrel has intersecting first and second passages formed therethrough. The first passage extends longitudinally through the mandrel, and the second passage extends laterally relative to the first passage. A flow control device selectively permits and prevents fluid communication with the second passage.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
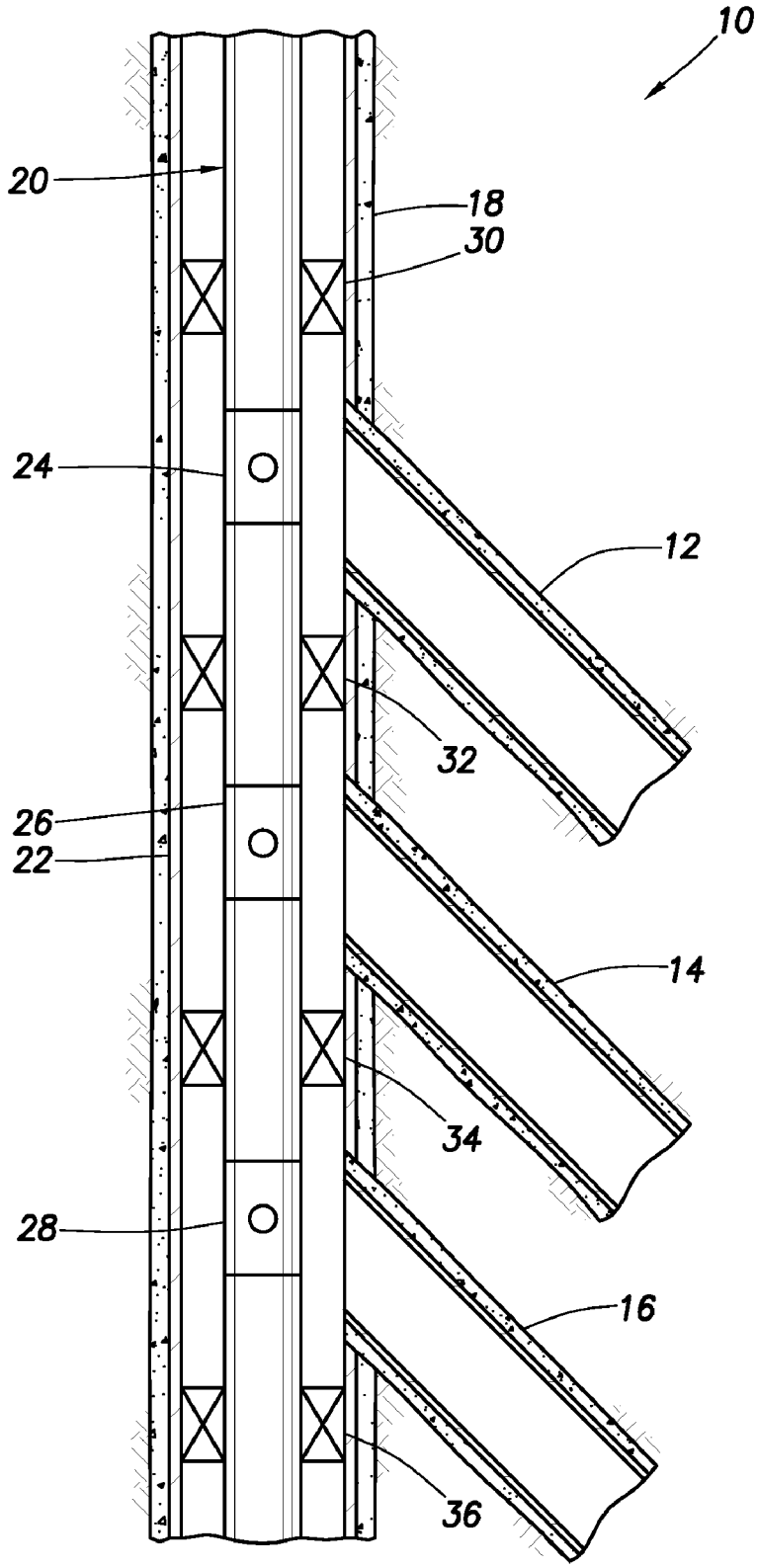
FIG. 1 (PRIOR ART)
FIG. 1 is a partially cross-sectional view of a prior art multilateral well completion system.

Illustrated in FIG. 1 is a prior art well completion system 10. In this system 10, multiple lateral or branch wellbores 12, 14, 16 are drilled extending outward from a main or parent wellbore 18. A completion string 20 is installed in a casing string 22 lining the parent wellbore 18.

The completion string 20 includes valves, such as sliding sleeve valves 24, 26, 28, for controlling flow between the respective branch wellbores 12, 14, 16 and the interior of the completion string. Packers 30, 32, 34, 36 provide isolation between the branch wellbores 12, 14, 16 and the respective valves 24, 26, 28 in the completion string. This arrangement permits flow from each branch wellbore 12, 14, 16 to be individually controlled by its respective valve 24, 26, 28.

However, the completion string 20 prevents access to the branch wellbores 12, 14, 16. The entire completion string 20 must be pulled from the well in order to provide access to any one of the branch wellbores 12, 14, 16. The completion string 20 must then be reinstalled in the well in order for production to resume.

Figure 2:
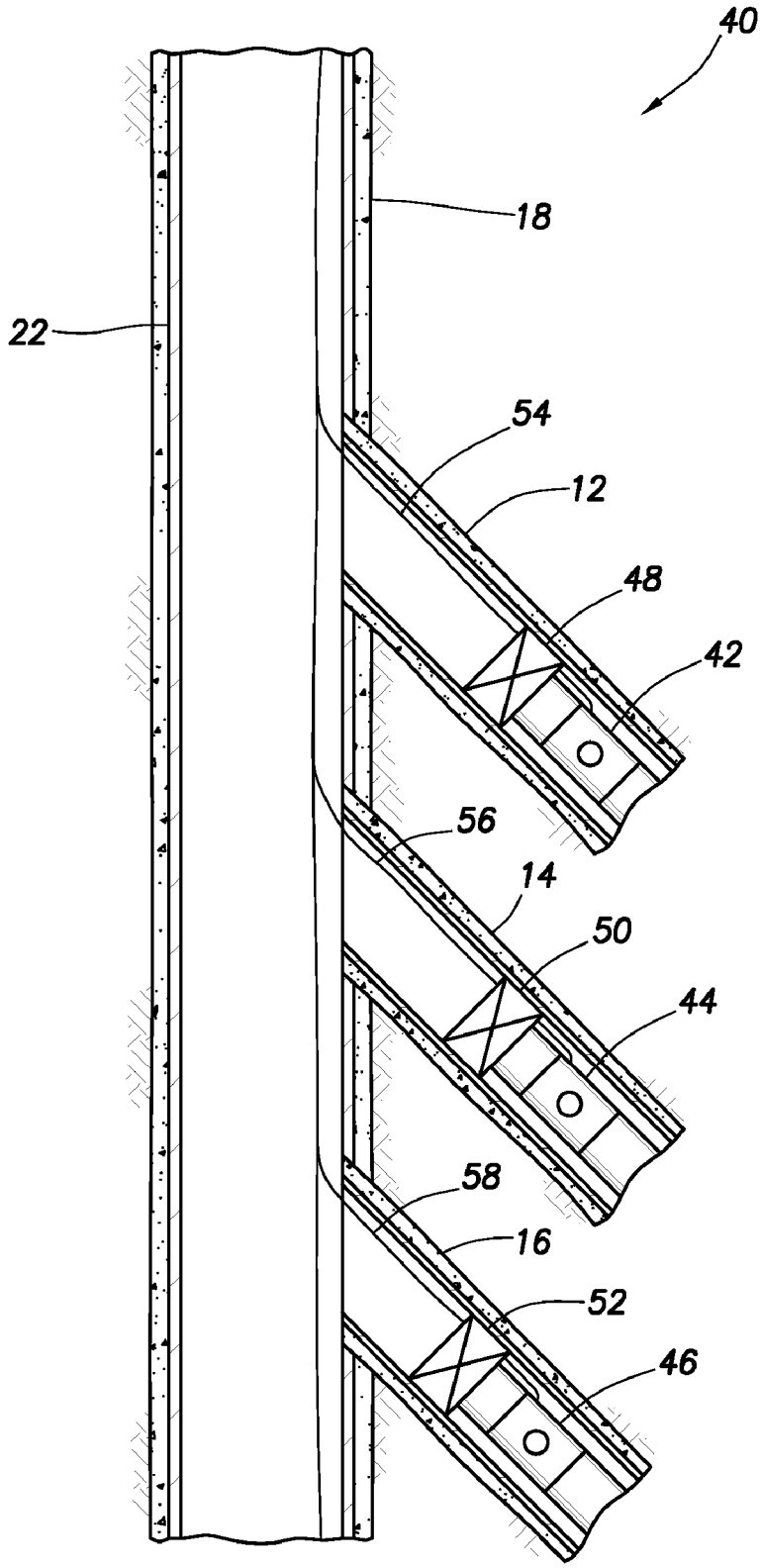
FIG.2 (PRIOR ART)
FIG. 2 is a partially cross-sectional view of another prior art multilateral well completion system.

Illustrated in FIG. 2 is another prior art well completion system 40. In this system 40, valves 42, 44, 46 are separately installed attached to respective packers 48, 50, 52 set in the branch wellbores 12, 14, 16. Thus, the valve 42 controls flow between the branch wellbore 12 and the parent wellbore 18, the valve 44 controls flow between the branch wellbore 14 and the parent wellbore, and the valve 46 controls flow between the branch wellbore 16 and the parent wellbore.

The valves 42, 44, 46 are individually operated via respective lines 54, 56, 58. The lines extend from the valves 42, 44, 46, through the packers 48, 50, 52 and into the parent wellbore 18. It will be readily appreciated that installation of the valves 42, 44, 46 and the corresponding lines 54, 56, 58 is very difficult and time-consuming, in particular requiring separate trips to install each of the valves and set its associated packer 48, 50, 52, and requiring running and interconnecting the various lines.

In addition, the lines 54, 56, 58 partially obstruct the interior of the casing string 22, where the lines are exposed to damage due to subsequent operations in the casing string. The valves 48, 50, 52 could be telemetry controlled without use of the lines 54, 56, 58, but this requires the valves to be powered by a downhole power source, such as batteries, which must be periodically replaced. Since the valves 48, 50, 52 are installed below the packers 48, 50, 52 in the branch wellbores 12, 14, 16, battery replacement would be a very difficult, time-consuming and expensive task.

Figure 3:
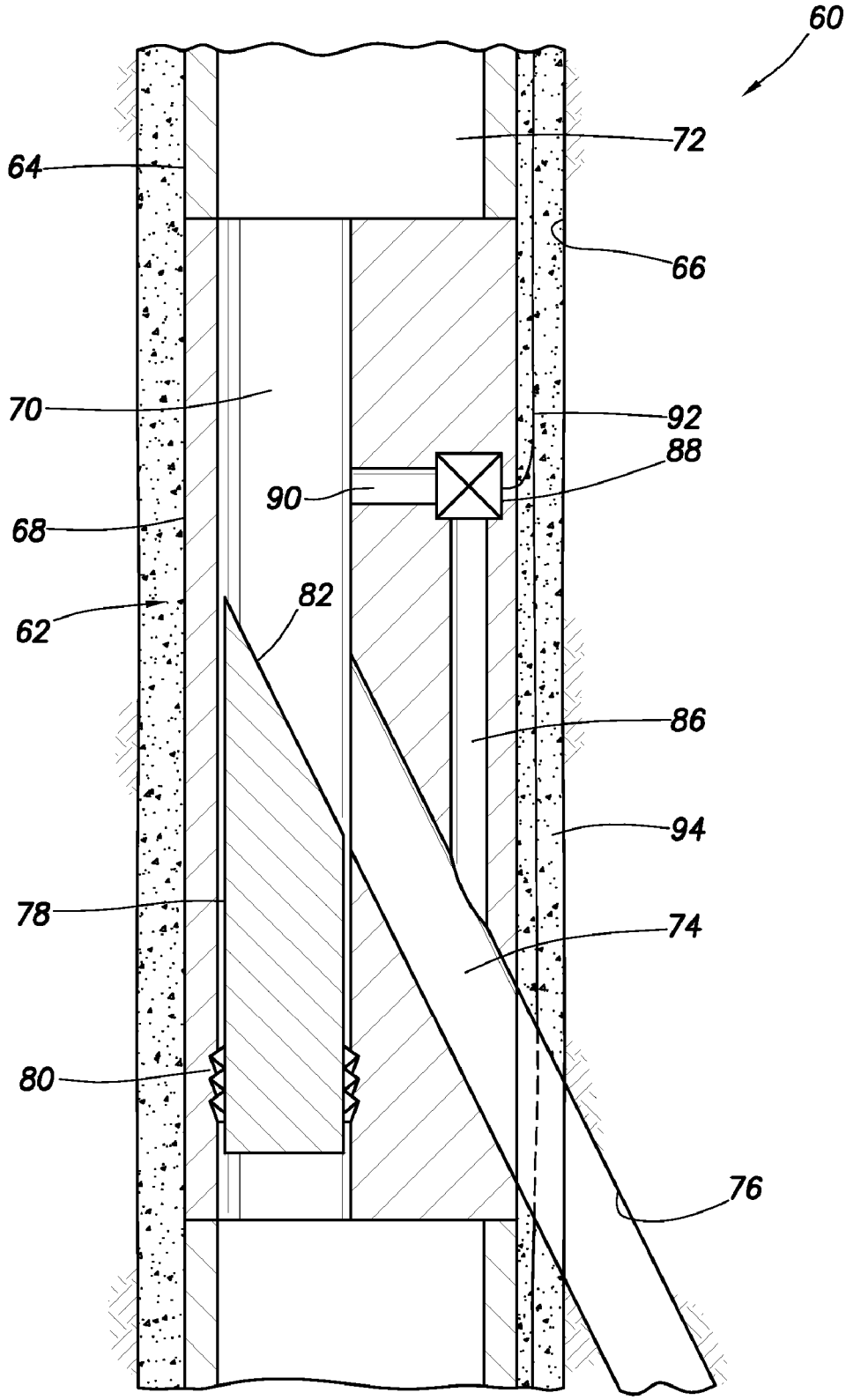
FIG. 3 is a schematic cross-sectional view of a system and method for completing a multilateral well, the system and method embodying principles of the present invention.

Representatively illustrated in FIG. 3 is a well completion system 60 which embodies principles of the present invention. In the following description of the system 60 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the system 60, an apparatus 62 is interconnected as part of a casing string 64, and is installed in a parent or main wellbore 66. As used herein, the terms "casing", "casing string", "cased" and the like are used to indicate any tubular string used to form a protective lining in a wellbore. A casing string may be made of any material, such as steel, plastic, composite materials, aluminum, etc. A casing string may be made up of separate segments, or it may be a continuous tubular structure. A casing string may be made up of elements known to those skilled in the art as "casing" or "liner".

The apparatus 62 includes a mandrel 68 which has a flow passage 70 formed longitudinally therethrough. The passage 70 forms a part of an internal passage 72 of the casing string 64 extending to the earth's surface. Another passage 74 formed in the mandrel 68 intersects the passage 70 and extends laterally relative to the passage 70. Although the mandrel 68 is depicted in FIG. 3 as being a single element having the passages 70, 74 formed therein, it should be clearly understood that the mandrel may be made up of any number of separate elements in keeping with the principles of the invention.

Preferably, the mandrel 68 and the remainder of the casing string 64 are cemented within the parent wellbore 66 to secure the casing string in the parent wellbore and prevent fluid migration between zones or formations intersected by the parent wellbore and any branch wellbore intersecting the parent wellbore. Prior to cementing the casing string 68 in the wellbore 66, the passage 74 is rotationally oriented to face in a desired direction for drilling a branch wellbore 76. As used herein, the terms "cementing", "cement" and the like are used to indicate any process using a material which is flowed between a tubular string and a wellbore, and which secures the tubular string in the wellbore and prevents fluid flow therebetween. Cement may include cementitious material, epoxies, other polymer materials, any hardenable and/or adhesive sealing material, etc.

After cementing, a deflecting device 78, such as a drilling whipstock, is installed in the passage 70. The device 78 engages a profile 8o formed internally in the mandrel 68. This engagement between the device 78 and the profile 80 rotationally aligns an upper deflecting surface 82 of the device with the passage 74.

One or more cutting tools, such as drills, mills, reamers, etc., are conveyed through the casing string 64 into the passage 70 and deflected laterally off of the surface 82 through the passage 74 to drill the branch wellbore 76. The apparatus 62 thus provides a convenient means for drilling the branch wellbore 76 extending outwardly from the parent wellbore 66. If multiple branch wellbores are desired, such as the branch wellbores 12, 14, 16 described above, multiple ones of the apparatus 62 may be interconnected in the casing string 64. The device 78 may then be installed in successive ones of the apparatuses 62 to drill the respective branch wellbores.

The device 78 may remain in the apparatus 62 while liners, well screens, or other equipment is installed in the branch wellbore 76. Alternatively, the device 78 could be replaced with another device better suited for deflecting such completion equipment into the branch wellbore 76. Note that the branch wellbore 76 may be completed open hole, with a liner string cemented therein, or in any other manner, in keeping with the principles of the invention.

The device 78, or other deflecting device, is then retrieved from the well. Fluid may be produced from the branch wellbore 76 through the passage 74, into the passage 70, and to the earth's surface via the casing string 64 if desired. Alternatively, fluid may be injected into the branch wellbore 76 from the casing string 64. As another alternative, fluid may be transferred from one branch wellbore to another using multiple apparatuses 62 interconnected in the casing string 64.

Preferably, in the system 60, fluid flow between the branch wellbore 76 and the interior of the casing string 64 does not pass directly between the passages 70, 74. Instead, direct flow between the passages 70, 74 is preferably blocked by a plug, such as the plug 84 described below (see FIGS. 4A & B). Flow between the branch wellbore 76 and the interior of the casing string 64 then passes through a passage 86 formed in the mandrel 68, through a flow control device 88, and through another passage go formed in the mandrel.

The passage 86 provides fluid communication between the passage 74 and the flow control device 88. The passage go provides fluid communication between the flow control device 88 and the passage 70. The flow control device 88 controls the flow of fluid between the passages 86, 90.

The flow control device 88 may be a valve, such as a sliding sleeve, flapper or ball valve. Alternatively, the flow control device 88 may be a flow regulating device, such as a choke, or a combined valve and choke. The flow control device 88 may selectively permit and prevent flow between the passages 86, 90.

The flow control device 88 may be hydraulically actuated, for example, by using hydraulic control lines connected to a hydraulic actuator or piston of the device. The flow control device 88 may be electrically actuated, for example, by using electric lines connected to an electrical actuator, such as a stepper motor or solenoid, of the device. Any other means of operating the flow control device 88 may be used, for example, by connecting a fiber optic line to an optical actuator of the device.

As depicted in FIG. 3, lines 92 are shown connected to the flow control device 88. These lines 92 may be hydraulic, electric, fiber optic, or any other type of lines which may be used to operate and/or communicate with the flow control device 88 from a remote location, such as the earth's surface, or another location in the well.

Note that the lines 92 preferably extend in the parent wellbore 66 external to the casing string 64. Thus, the lines 92 do not obstruct the interior of the casing string 64 and are not subject to damage due to operations performed in, or equipment conveyed through, the casing string. A suitable system for running the lines 92 external to the casing string 64 is the "Flat Pack" available from Halliburton Energy Services, Inc.

The lines 92 may include a fiber optic line for sensing temperature distribution in the annulus 94 between the casing string 64 and the parent wellbore 66. Such a distributed temperature sensing system used internal to a casing string is described in U.S. Pat. No. 5,163,321, the entire disclosure of which is incorporated herein by this reference. Of course, fiber optic lines may also be used to sense pressure in the annulus 94, as well.

The flow control device 88 may alternatively, or in addition, be communicated with or controlled remotely by means of telemetry. For example, electromagnetic, acoustic or pressure pulse telemetry may be used to transmit commands, codes or instructions from a remote location to a control module of the flow control device 88 to cause an actuator of the flow control device to open or close the device, or otherwise regulate flow therethrough. Such telemetry systems may also be used to transmit information from the flow control device 88 to the remote location, for example, to transmit indications of flow rate through the device, pressure drop across the device, temperature of fluid in the device, position of a closure member of the device, etc.

The flow control device 88 may use a downhole power supply. For example, the apparatus 62 may include batteries to supply power to the device 88. Recharging or replacement of the batteries is made much more convenient in the system 60, since the apparatus 62 is positioned in the parent wellbore 66, instead of in the branch wellbore 76. Alternatively, the flow control device 88 may be supplied with power from a downhole power generator, for example, of the type which includes a turbine driven by fluid flowing therethrough to drive an electrical generator, or of the type which includes a member vibrated by fluid flowing therethrough.

It may now be fully appreciated that the system 60 provides individual flow control for fluid flowing between the branch wellbore 76 and the casing string 64 in the parent wellbore 66. If other branch wellbores intersect the parent wellbore 66 and respective other apparatuses 62 are interconnected in the casing string 64, then each of these other branch wellbores also has individual flow control. That is, the flow control device 88 of each apparatus 62 may be operated to control fluid flow between the passages 70, 74 of each apparatus when the plug 84 is installed and blocking direct flow between the passages 70, 74.

When access to the branch wellbore 76 is desired, a deflecting device, such as the device 78, may be installed, the plug 84 may be retrieved, and access is then permitted through the passage 74 to the branch wellbore. When it is again desired to control flow between the passages 70, 74, the plug 84 is reinstalled and the deflecting device 78 is preferably retrieved from the well.

Note that fluid may be produced from the branch wellbore 76 using a completion string positioned in the casing string 64. For example, the completion string could be similar to the completion string 20 described above and illustrated in FIG. 1. In that case, packers, such as the packers 30, 32, 34, 36 could straddle the passages 90 of multiple ones of the apparatuses 62 interconnected in the casing string 64, so that fluid is produced from multiple branch wellbores, such as the branch wellbores 12, 14, 16, through the completion string.

Figures 4A, 4B:
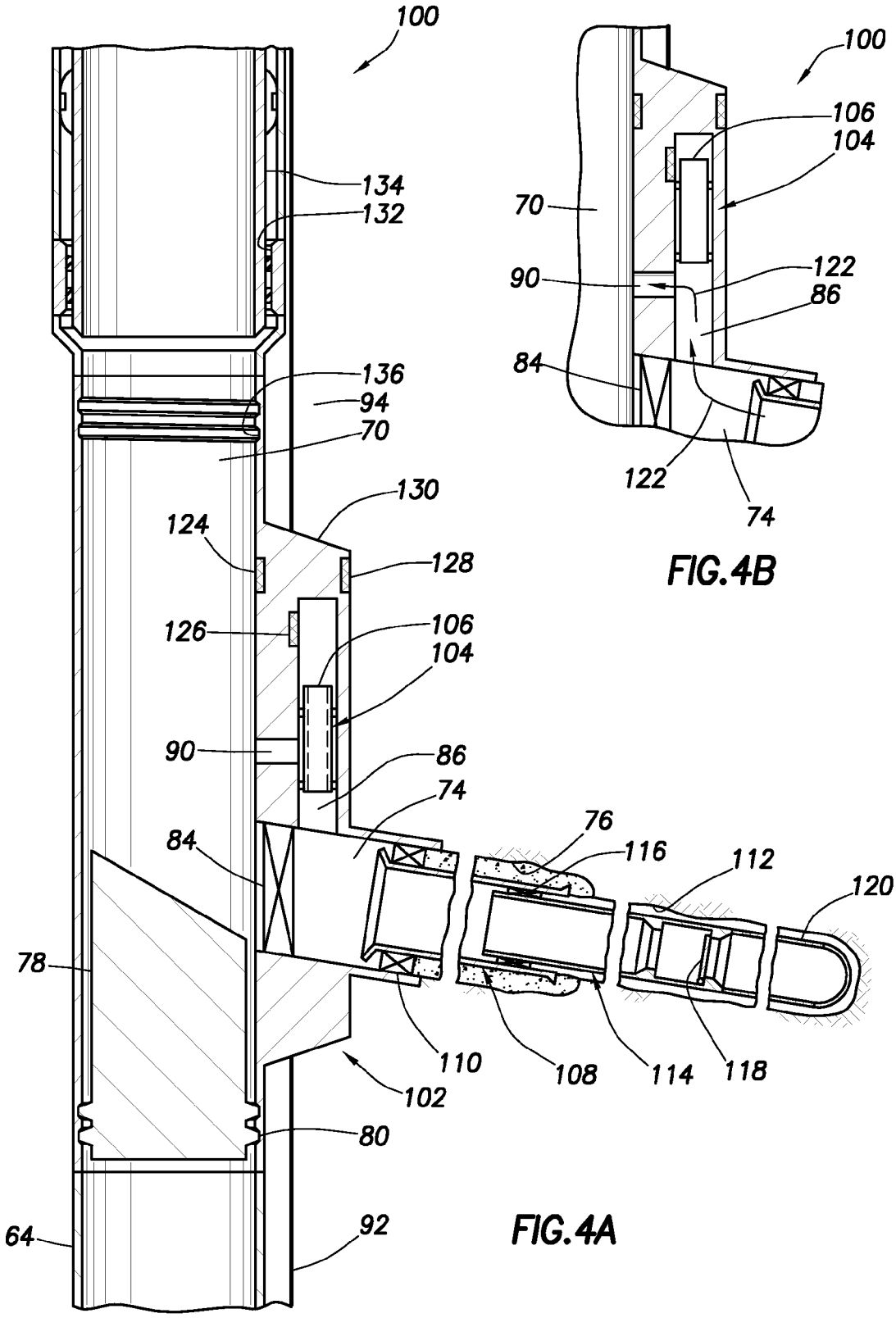
FIGS. 4A & B are schematic cross-sectional views of a second embodiment of a system and method incorporating principles of the present invention.

Referring additionally now to FIGS. 4A & B, another embodiment of a system 100 incorporating principles of the invention is representatively and schematically illustrated. The system 100 is similar in many respects to the system 60 described above, and so the same reference numbers are used in FIGS. 4A & B to indicate elements similar to those previously described. In addition, the system 100 is depicted apart from the parent wellbore 66 for clarity of illustration and description.

Instead of the apparatus 62 of the system 60, the system 100 is shown in FIGS. 4A & B as including a more detailed and somewhat differently configured apparatus 102. However, the apparatus 102 still performs essentially the same functions as the apparatus 62 described above. For example, the passages 70, 74 are provided for flow longitudinally through the casing string and for flow between the interior of the casing string 64 and the branch wellbore 76, respectively. The passages 86, 90 are provided for flow control between the passages 70, 74 when the plug 84 blocks direct flow between the passages 70, 74. A flow control device 104 is provided for controlling the flow through the passages 86, 90.

As depicted in FIGS. 4A & B, the flow control device 104 is a valve of the type known to those skilled in the art as a sliding sleeve valve. The device 104 includes a tubular sleeve or closure member 106 which is reciprocably and sealingly received in the passage 86. By displacing the sleeve 106 in the passage 86, flow may be permitted or prevented between the passages 86, 90 as desired.

The sleeve 106 may be displaced by any means, such as a hydraulic actuator, electric actuator, optical actuator, etc. An actuator for the flow control device 104 has not been illustrated in FIGS. 4A & B for clarity, but such actuators are well known to those skilled in the art. Any type of actuator may be used in the flow control device 104 without departing from the principles of the invention.

Although a sliding sleeve valve is depicted as the flow control device 104 of the apparatus 102, it should be clearly understood that any type of flow control device may be used in the apparatus. For example, the device 104 could be a ball valve, a choke, or a safety valve, etc. The sleeve 106 could be another type of closure member, such as a ball or a flapper, etc. The flow control device 104 could be remotely controlled and operated, or the flow control device could operate automatically in response to conditions sensed downhole, as described more fully below.

FIG. 4A illustrates in further detail one manner in which the branch wellbore 76 may be completed. A liner string 108 is installed in the branch wellbore 76 by deflecting the liner string off of the deflecting device 78, through the passage 74 and into the branch wellbore. An upper end of the liner string 108 is then sealed in the passage 74, preferably using a liner hanger 110 having a metal to metal seal. Of course, other types of seals, such as elastomer and non-elastomer seals, may be used in the liner hanger 110 in keeping with the principles of the invention.

The liner string 108 is cemented in the branch wellbore 76. An extension 112 of the branch wellbore 76 is drilled by deflecting one or more cutting tools off of the deflecting device 78, through the passage 74 and into the branch wellbore. An open hole completion string 114, including a packer 116, a flapper-type fluid loss control device 118 and one or more screens 120 is then installed in the branch wellbore extension 112, the packer is set in the liner string 108, and gravel is packed about the screens 120 using conventional techniques.

Preferably, the deflecting device 78 is retrieved from the well, and the plug 84 is installed in the passage 74, prior to producing fluid from the branch wellbore 76. Of course, fluid could be flowed directly between the passages 70, 74, without the plug 84 being installed, if desired.

FIG. 4A depicts one example of a method of completing the branch wellbore 76. The completion method is enhanced and made more convenient by the construction and operation of the apparatus 102. However, it should be clearly understood that the branch wellbore 76 may be completed in any manner without departing from the principles of the invention.

FIG. 4A also depicts the flow control device 104 in a closed configuration, wherein flow between the passages 86, 90 is prevented. Thus, when the plug 84 is installed, the flow control device 104 provides an effective means of controlling fluid flow between the branch wellbore 76 and the interior of the casing string 64, even completely preventing such flow if desired. In this respect, the flow control device 104 may operate as a safety valve, shutting off flow from, or into, the branch wellbore 76 in the event of an emergency experienced at the well, such as a blowout, severing of the lines 92, fire, etc. By positioning one of the apparatus 102 in the casing string 64 at each of multiple branch wellbores in the well, flow from or into each of the branch wellbores can be individually controlled, thereby enhancing the safety of operations at the well.

FIG. 4B depicts a portion of the apparatus 102 showing the flow control device 104 in an open configuration. Flow is now permitted between the passages 86, 90 and, thus, between the passages 70, 74, as indicated by the arrows 122. Although the sleeve 106 is shown in a position in which the flow 122 is completely unobstructed, it will be readily appreciated that the sleeve could be positioned so that it partially obstructs the fluid flow, thereby restricting, but not completely preventing flow through the flow control device 104. The flow control device 104, therefore, may act as a choke to regulate the flow 122 therethrough.

The apparatus 102 further includes sensors 124, 126, 128, depicted in FIGS. 4A & B as being attached to a mandrel 130 of the apparatus. The sensors 124, 126, 128 may be any type or combination of sensors, for example, sensors which detect pressure, temperature, fluid identity, fluid composition, resistance, flow rate, viscosity, density and/or nuclear resonance, etc. The sensors 124, 126, 128 may include thermocouples, strain gauges, optical fibers, quartz pressure sensors, piezoelectric pressure sensors, neural networks, vibrating tubes, acoustic properties detectors, electromagnetic sensors, etc.

Representatively, in the system 100, the sensors 124, 126, 128 each includes pressure and temperature sensors. The sensor 124 senses pressure and temperature of fluid in the passage 70. The sensor 126 senses pressure and temperature of fluid in the passage 86. The sensor 128 senses pressure and temperature of fluid in the annulus 94 external to the mandrel 130.

With the flow control device 104 closed as depicted in FIG. 4A, the sensor 126 is still able to sense the pressure and temperature of fluid in the passage 74 through the sleeve 106, since the sleeve is tubular. Thus, the sensor 126 may be useful in sensing the shut-in pressure and temperature of the branch wellbore 76. This information may be useful in testing the branch wellbore 76, for example, to determine the appropriate method of completing the branch wellbore, to determine whether any stimulation operations are needed for the branch wellbore, etc.

With the flow control device 104 open as depicted in FIG. 4B, the sensor 126 senses the flowing pressure and temperature of the fluid produced from the branch wellbore 76. This information may also be useful in evaluating various options for the branch wellbore 76. The sensor 124 senses the pressure and temperature of the fluid in the passage 70 downstream of the flow control device 104. Combined with the indications provided by the sensor 126, the pressure drop across the flow control device 104, the flow rate through the flow control device, etc., may be determined.

The sensor 128 senses pressure and temperature in the annulus 94. This information may be useful in determining whether a leak exists between the branch wellbore and the annulus 94. The sensor 128 may be used to determine a leak path and external casing flow identification between branch wellbores. The sensor 128 may also be used to determine whether voids have been left in the cement in the annulus 94, etc. Another method of sensing fluid properties in the annulus 94 is to install an optical fiber in one or more of the lines 92, as mentioned above for the system 60.

Indications of fluid properties, or other types of indications produced by the sensors 124, 126, 128, may be transmitted to a remote location via the lines 92 connected to the sensors. Alternatively, the indications from the sensors 124, 126, 128 may be transmitted via telemetry, such as electromagnetic, acoustic or pressure pulse telemetry.

As mentioned above, the flow control device 104 may be operated automatically in response to conditions in the well. For example, the flow control device 104 may be operated in response to a pressure differential detected by the sensors 124, 126. A flow rate sensor connected via appropriate circuitry to an actuator of the flow control device 104 may be used to position the sleeve 106 so that a desired flow rate is maintained.

These features of the system 100 would be very useful in the situation referred to in the Background section, wherein production from different reservoirs is commingled in the parent wellbore 66. If one of the apparatuses 102 is installed at each branch wellbore intersecting the different reservoirs, then the pressures in each of the reservoirs may be continuously monitored, along with the production rate from each reservoir, etc. This would allow the flow control devices 104 to automatically shut-in branch wellbores whose reservoir pressure is incompatible with the flowing pressure in the parent wellbore 66 (e.g., to prevent one reservoir from flowing into another reservoir), increase production from other branch wellbores, etc., without intervention into the well.

As another example, a sensor at a remote location, such as the earth's surface, may sense an emergency situation, such as a fire, and cause the flow control device 104 to automatically close. A sensed emergency situation may cause each of the flow control devices 104 of multiple apparatuses 102 interconnected in the casing string 64 to close, thereby shutting off fluid flow from multiple branch wellbores at the same time.9 As yet another example, the flow control device 104 may automatically close if the sensor 128 or a distributed temperature sensing system in the lines 92 detects a leak in the annulus 94 outside the casing string 64. Therefore, it will be readily appreciated that the system 100 provides a far greater degree of control and safety in operation of the well than has been available in the past.

As depicted in FIG. 4A, the casing string 64 above the apparatus 102 includes a seal bore or PBR 132. A lower end of a production tubing string 134 is sealingly received in the seal bore 132. Fluid produced from the branch wellbore 76 is flowed to a remote location via the production tubing string 134. This is a completion of the type known to those skilled in the art as a "monobore" completion, although any other type of completion in the parent wellbore may be used in keeping with the principles of the invention.

The mandrel 130 includes an internal orienting profile 136 formed in the passage 70 above the passage 90. This profile 136 may be used to anchor and/or orient various items of equipment in the mandrel 130. In an embodiment described below, the profile 136 is used in maintaining the flow control device 104.

Figure 5:
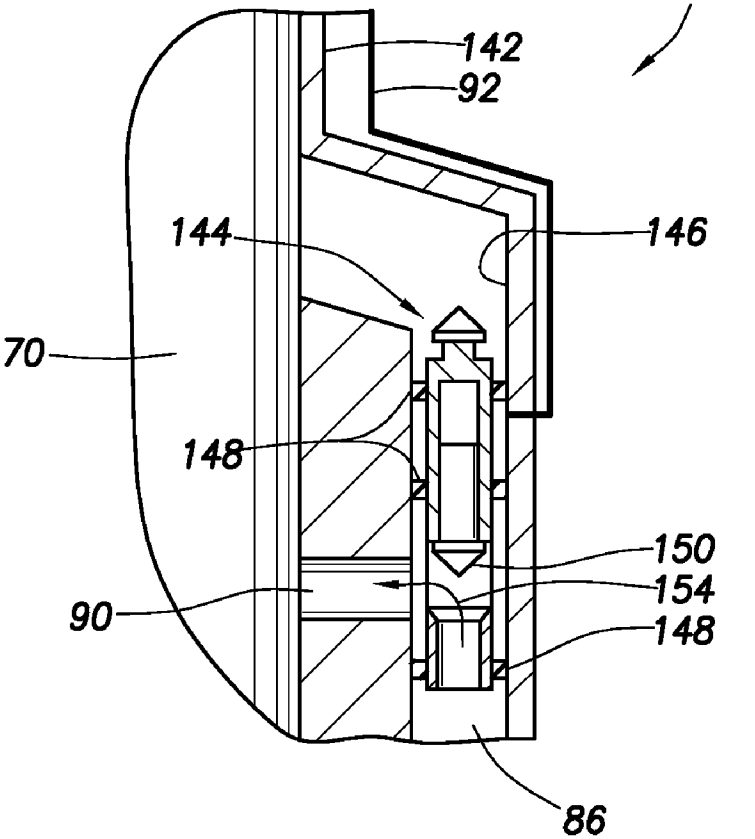
FIG. 5 is a schematic cross-sectional views of a third embodiment of a system and method incorporating principles of the present invention.

Referring additionally now to FIG. 5, another system 140 incorporating principles of the invention is representatively and schematically illustrated. The system 140 is similar in many respects to the systems 60, 100 described above, and so the same reference numbers are used in FIG. 5 to indicate elements previously described. Only a portion of the system 140 is depicted in FIG. 5 for illustrative clarity.

The system 140 includes a mandrel 142 similar in many respects to the mandrels 68, 130 described above. One difference, however, is that a flow control device 144 in the mandrel 142 is installed in a passage 146 which is open to the passage 70 formed longitudinally through the mandrel.

As depicted in FIG. 5, the flow control device 144 is a safety valve and the closure member 150 is a plunger-type closure. The closure member 150 is raised to an open position as shown in FIG. 5 by fluid pressure in a hydraulic line of the lines 92. In the open position of the closure member 150, the flow control device 144 permits fluid (indicated by arrow 154) to flow between the passages 86, 90. When the flow control device 144 is closed, for example, by loss of hydraulic pressure in one of the lines 92, flow is prevented between the passages 86, 90.

As mentioned above, the flow control device 144 may be supplied with power from downhole batteries which need periodic recharging or replacement, or there may be another reason to perform maintenance on the flow control device. For example, seals 148 on the flow control device 144 may need to be replaced, the closure member 150 may need to be repaired or replaced, etc.

In order to perform such maintenance on the flow control device 144, a tool of the type known to those skilled in the art as a "kickover" tool 152 is conveyed into the mandrel 142. Such kickover tools are used, for example, to install and maintain gas lift valves or chemical injection valves positioned in side pocket mandrels.

Figure 6:
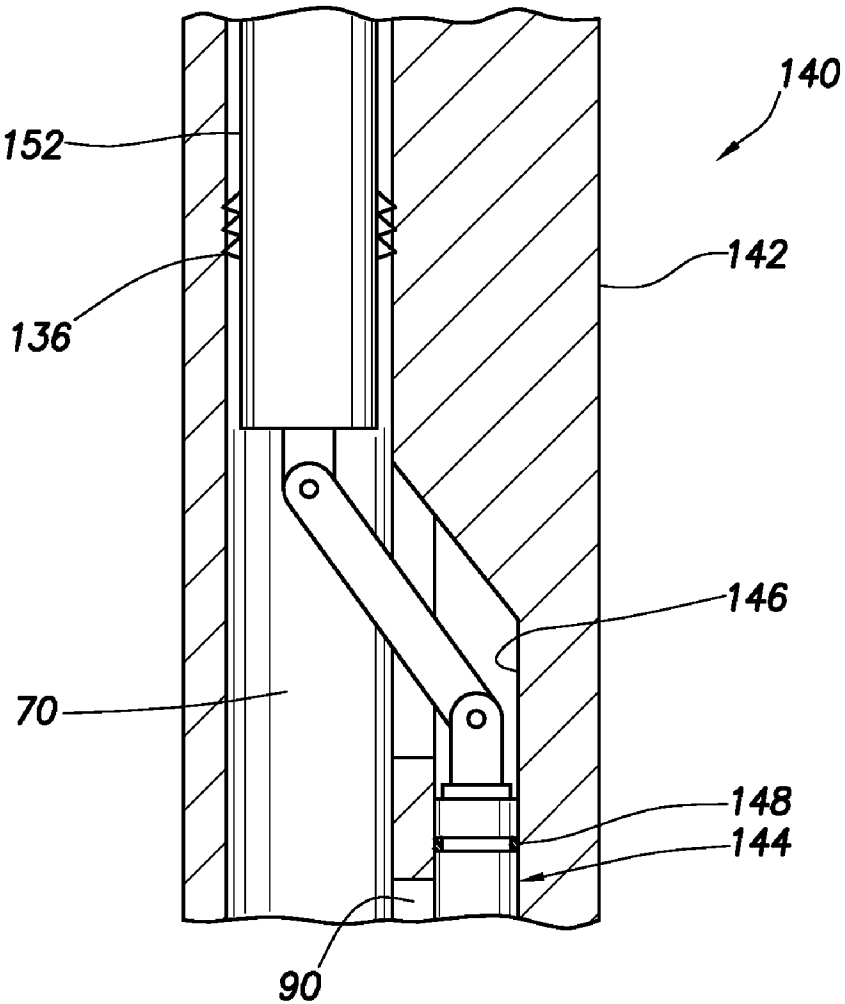
FIG. 6 is a schematic cross-sectional view of the third embodiment of FIG. 5, wherein a flow control device is being retrieved.

The kickover tool 152 is shown engaged with a portion of the flow control device 144 in FIG. 6. By engaging the kickover tool 152 with the orienting profile 136 in the mandrel 142, the kickover tool is rotationally oriented so that it is aligned with the passage 146 and the flow control device 144.

The flow control device 144 and/or its batteries, seals, closure member, etc. may now be retrieved from the mandrel 142 by the kickover tool 152 and conveyed out of the well for recharging, repair or replacement. It may now be fully appreciated how the system 140 provides for convenient maintenance of the flow control device 144 which controls flow between branch and parent wellbores. This manner of maintaining the flow control device 144 may also be used in the systems 60, 100 described above, with appropriate modification.

Figure 7:
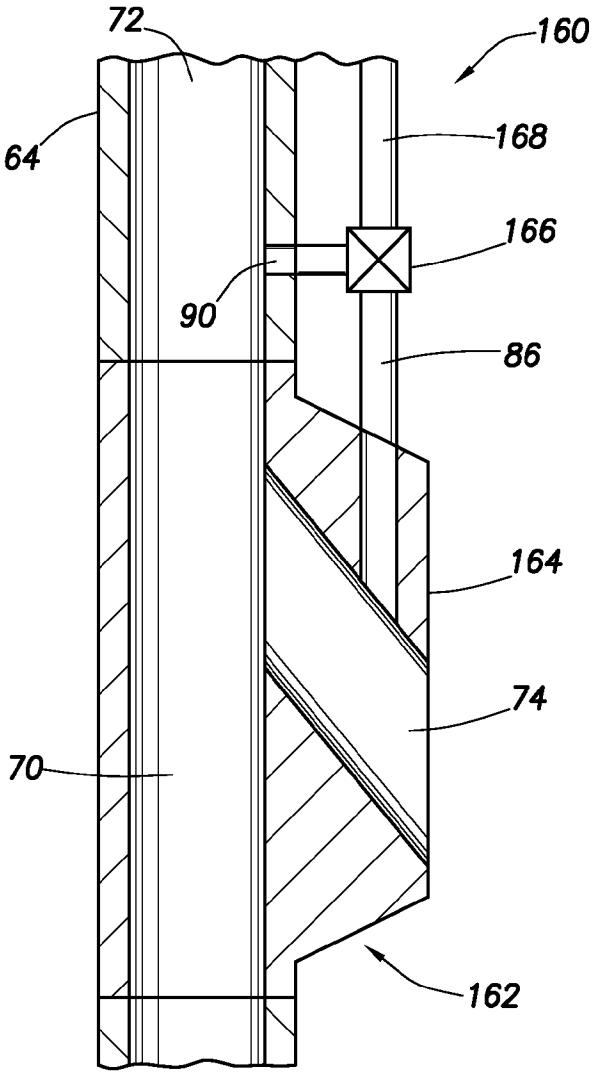
FIG. 7 is a schematic cross-sectional view of a fourth embodiment of a system and method incorporating principles of the present invention.

Referring additionally now to FIG. 7, another system 160 incorporating principles of the invention is representatively and schematically illustrated. The system 16o is shown apart from the remainder of the well for illustrative clarity. The system 16o includes an apparatus 162 which is similar in many respects to the system 6o illustrated in FIG. 3. The same reference numbers are used to indicate elements shown in FIG. 7 which are similar to elements shown in FIG. 3.

The apparatus 162 includes a mandrel 164 which has the passages 70, 74 formed therein. One difference between the mandrel 164 depicted in FIG. 7 and the mandrel 68 depicted in FIG. 3 is that the mandrel 164 does not have a flow control device 166 positioned therein. Instead, the flow control device 166 is positioned external to the mandrel 164.

As shown in FIG. 7, the flow control device 166 is positioned above the mandrel 164. However, it should be understood that the flow control device 166 could be otherwise positioned relative to the mandrel 164. For example, the flow control device 166 could be below or laterally adjacent the mandrel 164, and the flow control device could be below or laterally adjacent the passage 74. Thus, any positioning of the flow control device 166 relative to the mandrel 164 may be used in keeping with the principles of the invention.

The passage 86 providing fluid communication between the passage 74 and the flow control device 166 extends external to the mandrel 164, where it connects to the flow control device. In a similar manner, the passage 90 providing fluid communication between the flow control device 166 and the passage 70 extends external to the mandrel 164. In fact, the passage 90 does not extend in the mandrel 164 at all, but instead extends through a sidewall of the casing string 64 above the mandrel. Thus, it will be appreciated that the passages 86, 90 may be positioned in any manner relative to the mandrel 164 and relative to the passages 70, 74 in keeping with the principles of the invention.

When direct flow between the passages 70, 74 is prevented, for example, by installing the plug 84 in the passage 74 as described above, the flow control device 166 controls flow between the passage 74 and the passage 72 of the casing string 64, without that flow first passing through the passage 70 in the mandrel 164. Thus, it will be appreciated that any configuration of the passages 70, 72, 74, 90 may be used in keeping with the principles of the invention.

It may be advantageous in some circumstances to produce fluid from the branch wellbore 76 via a passage 168 separate from the passage 72 extending through the casing string 64. The passage 168 may extend from the flow control device 166 to a remote location, such as the earth's surface or another location in the well. In that case, the passage 90 may or may not be provided in the apparatus 162.

If the passage 90 is provided, the flow control device may be of the type known to those skilled in the art as a "three way" valve. That is, the flow control device 166 may selectively permit and prevent fluid communication between the passage 86 and either one of the passages 90, 168. Preferably, the flow control device 166 would also regulate flow between the passage 86 and either of the passages 90, 168 selected for fluid communication with the passage 86.

The separate passage 168 permits production of fluid from, or injection of fluid into, the branch wellbore 76 while other operations are performed in the passages 70, 72. For example, another wellbore, such as another branch wellbore, may be drilled via the passages 70, 72, while fluid is produced from the branch wellbore 76 associated with the apparatus 162. If multiple ones of the apparatus 162 are interconnected in the casing string 64, in order to drill multiple branch wellbores 76, fluid may be produced from more than one of the branch wellbores while another branch wellbore is being drilled.

Thus, the system 160 demonstrates the versatility in well operations and configurations provided by the principles of the invention. The benefits of the invention are achieved in the embodiments described herein, without undue complication or difficulty in installing and maintaining a well completion, without unduly restricting access to branch wellbores, and without requiring flow control devices to be installed in each of the branch wellbores.

However, it should be understood that flow control devices could be installed in branch wellbores and access to branch wellbores could be restricted without departing from the principles of the invention.

It may now be appreciated that the systems 60, 100, 160 described above are intelligent well completions, and the respective apparatuses 62, 102, 162 are portions of those intelligent well completions. As used herein, the term "intelligent well completion" is used to indicate a well completion that, without intervention, allows continuous downhole monitoring and/or continuous downhole control of wellbore fluids, and is deployed within a production and/or injection system. The sensors described herein, such as the sensors 124, 126, 128, provide the continuous downhole monitoring of wellbore fluids, and the flow control devices 88, 104, 166 provide the continuous downhole control of wellbore fluids.

Figure 8:
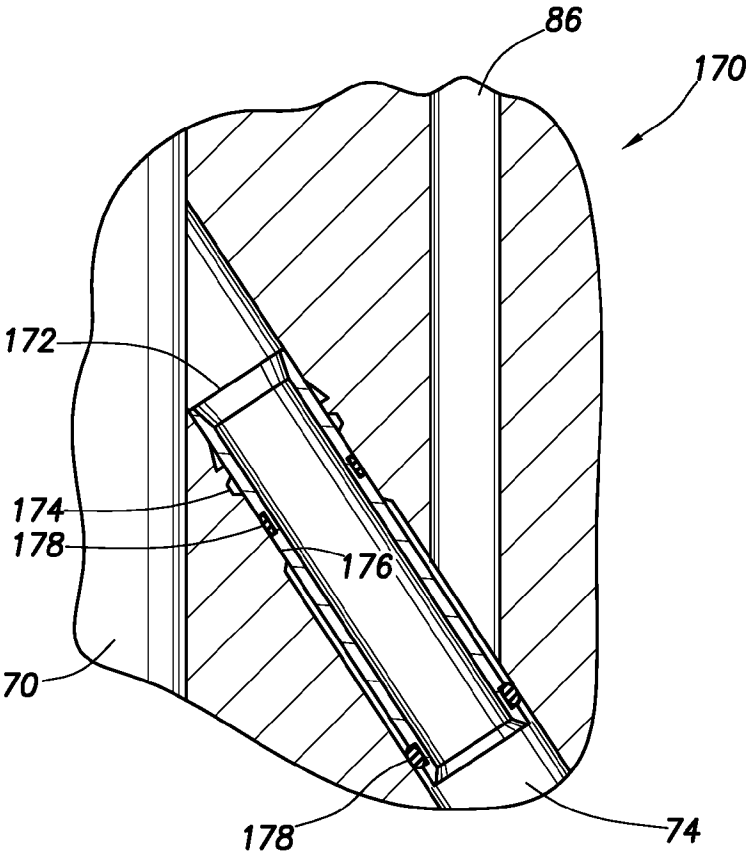
FIG. 8 is a schematic cross-sectional view of a fifth embodiment of a system and method incorporating principles of the present invention.

Referring additionally now to FIG. 8, another system 170 is representatively illustrated. The system 170 includes a generally tubular wear bushing 172 which is installed in the passage 74 during drilling operations. The wear bushing 172 may be used in any of the systems and methods 60, 100, 160 described above. For example, in the system 100, the wear bushing 172 would be installed in the passage 74 while the branch wellbore 76 is being drilled. For clarity of description, the use of the wear bushing 172 will be described below as it is used with the system 100 shown in FIGS. 4A & B.

The wear bushing 172 preferably performs several functions. First, it lines the passage 74 to prevent wear due to the cutting tools, drill strings, etc. passing through the passage. Second, it protects an internal profile 174 formed in the passage 74. Third, it protects an internal seal bore 176 formed in the passage 74. Fourth, it isolates the passage 86 from the passage 74 (by means of seals 178 on the wear bushing 172 straddling the passage 86).

The wear bushing 172 may engage the profile 174 for anchoring the wear bushing in position relative to the passage 74. Later, after the drilling operation is completed, the profile 174 may be used to anchor the plug 84 in position. The seal bore 176 may be used to provide a sealing surface for the plug 84 when it is installed. Alternatively, or in addition, the wear bushing 172 may protect another seal surface in the passage 74 for the liner hanger 110.

After the drilling operation is completed, the wear bushing 172 is retrieved from the passage 74. The liner string 108 and completion string 114 are then installed. The wear bushing 172 may be re-installed if further drilling operations are performed in the branch wellbore 76 (e.g., after installing the liner string 108 and prior to drilling the extension 112).

Once the branch wellbore 76 is completed, the plug 84 is installed so that it anchors to the profile 174 and seals in the seal bore 176. Fluid may then be injected through, or produced from, the passage 74 via the passage 86. If the plug 84 is not used, fluid may flow between the passages 70, 74 as described above.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A completion system for a well having an intersection between first and second wellbores, the system comprising:

an apparatus having first and second passages formed therethrough, the first passage providing fluid communication between opposite ends of the apparatus in the first wellbore, and the second passage providing guidance for drilling the second wellbore extending laterally from the first wellbore, the apparatus further including a flow control device selectively controlling fluid communication with the second passage, direct fluid communication between the first and second passages being prevented while the flow control device permits flow between the second passage and a third passage extending to the earth's surface; and wherein the flow control device selectively permits fluid communication between the second passage and the first and third passages.

2. The system of claim 1, wherein the flow control device comprises a three-way valve.

3. The system of claim 1, wherein the flow control device provides fluid communication with the first passage via a fourth passage interconnecting the flow control device to the first passage.

4. A completion system for a well having an intersection between first and second wellbores, the system comprising:

an apparatus having first and second passages formed therethrough, the first passage providing fluid communication between opposite ends of the apparatus in the first wellbore, and the second passage providing guidance for drilling the second wellbore extending laterally from the first wellbore, the apparatus further including a flow control device selectively controlling fluid communication with the second passage, direct fluid communication between the first and second passages being prevented while the flow control device permits flow between the second passage and a third passage extending to the earth's surface; and a generally tubular bushing which, when positioned in the second passage, is operative to prevent direct fluid communication between the second and third passages while permitting fluid communication and access between the first and second passages.

* * * * *